United States Patent [19]

Miller et al.

[11] 4,069,357

[45] Jan. 17, 1978

[54] PROCESS FOR DIFFUSING METALLIC COATINGS INTO CERAMICS TO IMPROVE THEIR VOLTAGE WITHSTANDING CAPABILITIES

[75] Inventors: H. Craig Miller, Clearwater; Herbert F. Zuhr, St. Petersburg, both of Fla.

[73] Assignee: The United States of America as represented by the United States Department of Energy, Washington, D.C.

[21] Appl. No.: 740,339

[22] Filed: Nov. 9, 1976

[51] Int. Cl.[2] ..... H01B 17/42; H01B 17/64; H01B 17/50

[52] U.S. Cl. ..... 427/123; 427/126; 427/190; 427/191; 427/229; 174/137 A; 427/377; 427/383 B; 428/469

[58] Field of Search ..... 427/126, 123, 58, 229, 427/377, 380, 383 A, 383 B, 376 A, 376 B, 376 E, 376 G; 174/137 R, 137 A, 137 B, 138 R, 138 C, 140 C, 141 C; 313/292, 313; 252/520; 428/469

[56] References Cited

U.S. PATENT DOCUMENTS

| | | | |
|---|---|---|---|
| 2,715,593 | 8/1955 | Clark | 427/376 A |
| 2,996,401 | 8/1961 | Welsh et al. | 427/123 X |
| 3,197,290 | 7/1965 | Williams | 427/376 B |
| 3,686,007 | 8/1972 | Gion | 174/137 B |

FOREIGN PATENT DOCUMENTS

| | | | |
|---|---|---|---|
| 932,507 | 7/1964 | France | 427/376 B |

*Primary Examiner*—Ralph S. Kendall
*Attorney, Agent, or Firm*—Dean E. Carlson; Dudley W. King; Robert W. Weig

[57] ABSTRACT

The disclosure relates to a method for diffusing a coating of manganese powder and titanium powder into a ceramic to improve its voltage hold off withstanding capability. The powder coated ceramic is fired for from about 30 to about 90 minutes within about one atmosphere of wet hydrogen at a temperature within the range of from about 1450° to about 1520° C to cause the mixture to penetrate into the ceramic to a depth on the order of a millimeter.

6 Claims, 3 Drawing Figures

PROCESS FOR DIFFUSING METALLIC COATINGS INTO CERAMICS TO IMPROVE THEIR VOLTAGE WITHSTANDING CAPABILITIES

FIELD OF THE INVENTION

The invention relates to ceramic insulators and more particularly to a method for diffusing metallic coatings into ceramic insulators to improve their voltage withstanding capabilities.

BACKGROUND OF THE INVENTION

High alumina insulators are useful for situations where a high voltage difference must be sustained between conductors which must be physically connected while maintaining a clean vacuum environment. It is desirable to improve the voltage hold off capability of ceramic insulators because improved voltage hold off capability means a smaller size insulator can be used for any given required hold off. Thus, equipment utilizing such insulators can be smaller, capable of higher performance, more efficient and the like. It is also frequently desirable to minimize the buildup of electric charge on an insulator's surface, because such a charge can distort electric fields near the insulator and adversely affect the performance of the device incorporating the insulator, even though high voltage breakdown does not occur

SUMMARY OF THE INVENTION

In accordance with the present invention there is provided a method for diffusing a coating into a ceramic to improve the ceramic's voltage hold off withstanding capability. In a preferred embodiment, an alumina ceramic insulator is coated with a mixture of manganese powder and titanium powder and is fired for about 30 to about 90, but preferably from about 40 to about 50 minutes in about one atmosphere of wet hydrogen at a temperature of from about 1450° to about 1520° C to cause the mixture to penetrate into the ceramic to a depth on the order of a millimeter. The manganese powder can comprise manganese (Mn) or manganese dioxide ($MnO_2$); the titanium powder may comprise titanium hydride ($TiH_2$) or titanium dioxide ($TiO_2$).

One object of the present invention is to increase the voltage hold off withstanding capabilities of ceramic insulators.

Another object of the present invention is to provide an insulator with an ability to leak away a surface charge in a shorter period of time than prior art insulators.

Still another object of the present invention is to provide improved voltage grading along a ceramic insulator.

Yet another object of the present invention is to provide a ceramic insulator with a more dielectrically uniform surface.

One advantage of the present invention is that ceramic insulators in accordance therewith have lower secondary electron emission coefficients than do comparable untreated ceramic insulators.

Another advantage of the present invention is that in accordance therewith, coated ceramics can be metallized without modification to ordinary metallizing procedures.

Still another advantage of the present invention is that diffused coatings in accordance therewith are less vulnerable to damage from mechanical or electrical stresses than prior art coatings

BRIEF DESCRIPTION OF THE DRAWINGS

Other objects and advantages of the instant invention will be apparent to those skilled in the art from the followIng description with reference to the appended drawings wherein like numbers denote like parts and wherein.

DETAILED DESCRIPTION OF A PREFERRED EMBODIMENT OF THE INVENTION

The term "insulator" herein comprises devices used to inhibit electric current from traveling from one place to another. Insulators are used in various devices, such as vacuum tubes, vacuum electrical feedthroughs, mass spectrometers, electron guns, particle accelerators, energy analyzers, and the like.

A ceramic article such as an insulator comprising a 94% alumina ceramic can be coated with a mixture of four parts manganese powder by weight of metal and three parts titanium hydride powder by weight of metal. The coated insulator may then be fired for from about 30 to about 90 minutes and preferably from about 40 to about 50 minutes in a wet hydrogen atmosphere at a pressure of about one atmosphere and at temperatures from about 1450° to about 1520° C. The heating causes the coating mixture to penetrate into the ceramic to depths on the order of a millimeter. The depth of penetration is determined by the temperatures and firing times used and may range from a few tenths of a millimeter to several millimeters. In a particular example, a 94% alumina ceramic insulator coated with a mixture of four parts manganese (Mn) to three parts titanium ($TiH_2$) was fired for approximately 45 minutes in wet hydrogen at a temperature of essentially 1495° C. Room temperature resistivity of the alumina was reduced from greater than $10^{15}$ ohm-cm to a resistivity of on the order of $10^{10}$ to $10^{13}$ ohm-cm. In the example, the actual resistivity of the untreated insulator was probably at least about $10^{18}$ ohm-cm. The coated insulator had significantly better voltage withstand capability than identical but uncoated insulators.

Figure 1:
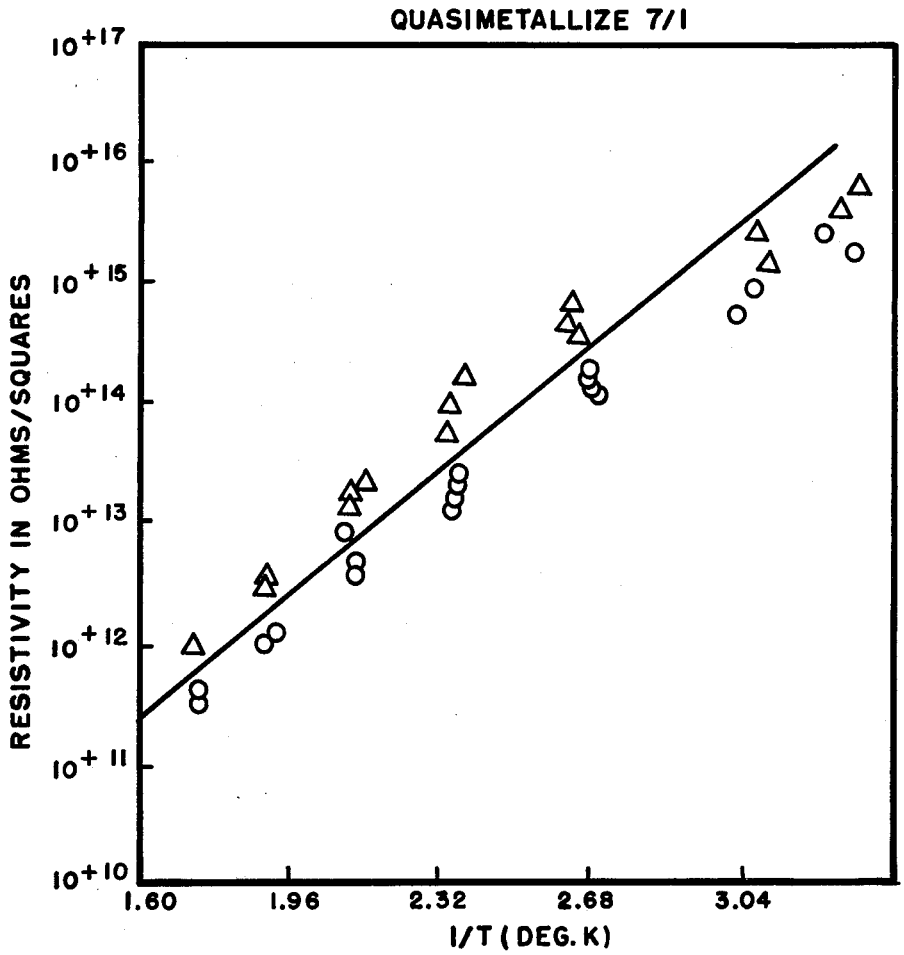
FIG. 1 graphically depicts the dependence of resistivity in ohms per square upon the temperature of an insulator in accordance with the present invention.
Figure 2:
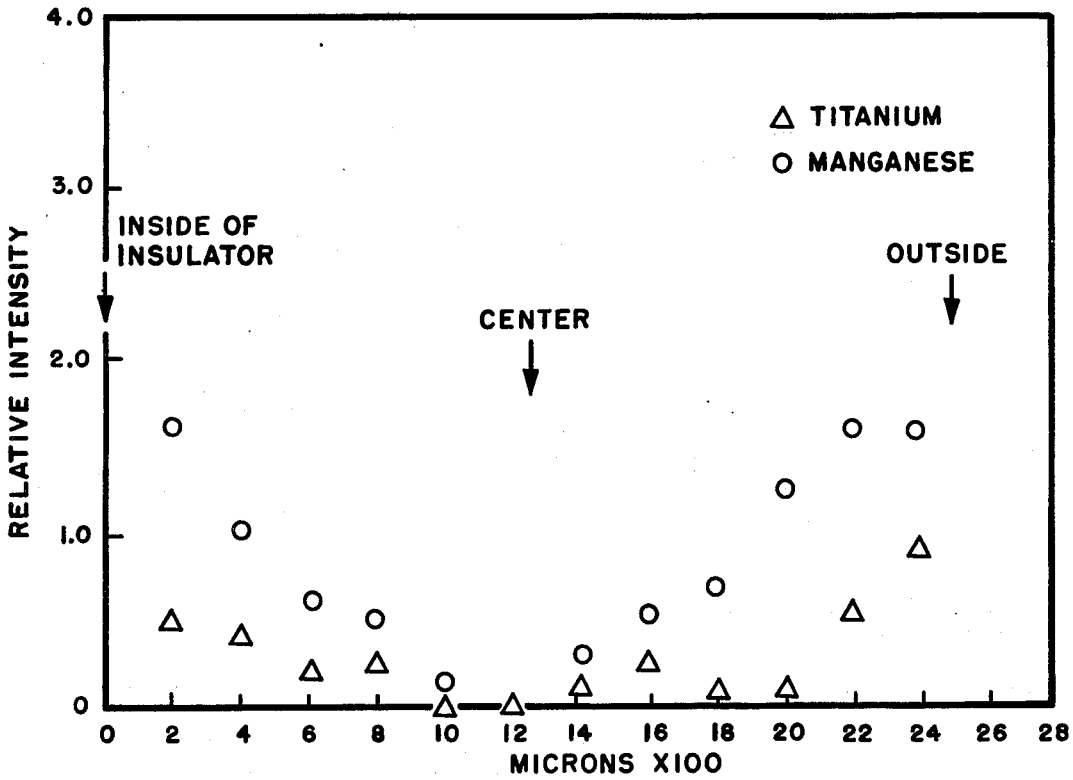
FIG. 2 illustrates the distribution of titanium and manganese in a section through the wall of an alumina cylinder treated with the method of the invention on both its inner and outer wall surfaces.
Figure 3:
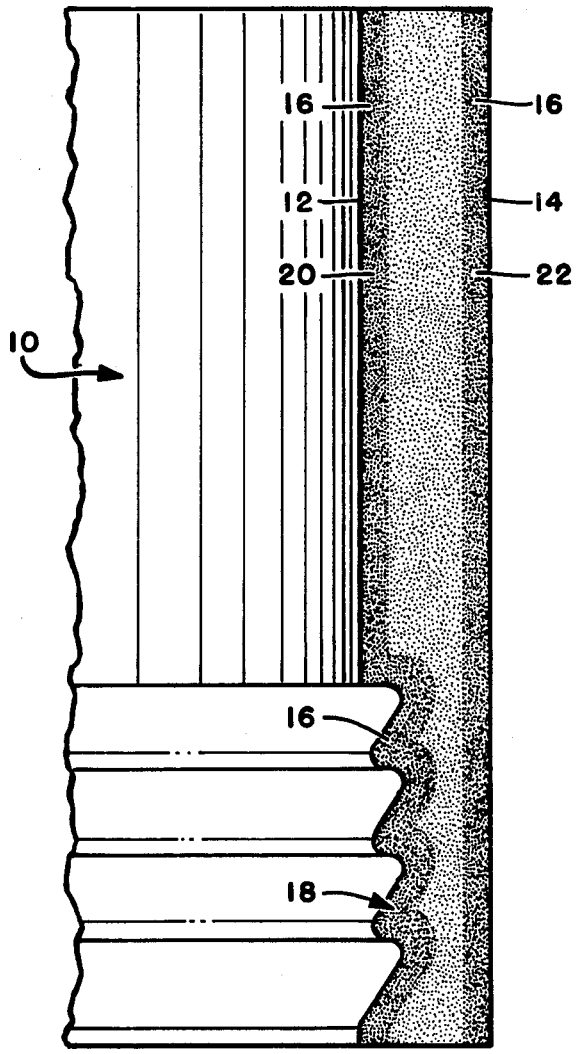
FIG. 3 illustrates an exemplary embodiment of the invention.

FIG. 3 is a cross-sectional showing of a portion of an exemplary hollow insulator 10 which may comprise, for example, alumina. Insulator 10 has two surfaces 12 and 14 through which a metallic coating 16 is diffused into areas 18, 20 and 22. It will be noted that the insulator surface through which the metallic coating is diffused need not be flat, but may be any shape desired. The diffused metal within insulator 10 will be distributed similarly to that exemplified by FIG. 2.

It will be appreciated that the heating step may be segregated into two or more steps for various industrial processing reasons. The mixture ratios for the manganese and titanium powders may range from about two parts manganese and five titanium to more than seven parts manganese and one part titanium all by weight of metal. The mixtures with the higher amount of titanium to manganese are more difficult to consistently apply because they require more care to insure a uniform surface coating before the firing step. The mixture is normally applied to visually cover the desired surface.

It has been found that the manganese powder may comprise pure manganese or manganese dioxide $MnO_2$ and that the titanium may be titanium dioxide $TiO_2$ or titanium hydride $TiH_2$. The media grain size of the materials used preferably lies in the range of from about 1.3 to about 2.6 microns, with a maximum size of about 10 microns.

Because the coating is diffused into the insulator itself, the insulator is less easily chipped from mechanical encounter with other objects and also less vulnerable to electric stresses which might, for example, burn off or vaporize a purely external coating. The conductive nature of the surface layer of the insulator allows a small current to flow which improves the voltage grading along the insulator.

The various features and advantages of the invention are thought to be clear from the foregoing description. However, various other features and advantages not specifically enumerated will undoubtedly occur to those versed in the art, as likewise will many variations and modifications of the embodiments illustrated herein, all of which may be achieved without departing from the spirit and scope of the invention as defined by the appended claims.

What is claimed is:

1. A method for penetratingly covering an alumina ceramic insulator with metal so that the metal is diffused into the surface of the insulator a preselected amount, the method comprising:

coating the insulator with a mixture comprising manganese powder and titanium powder, the manganese and titanium powder mixture ranging from about two parts by metal weight of manganese and five parts by metal weight of titanium to about seven parts by metal weight of manganese and one part by metal weight of titanium, the manganese and titanium together constituting essentially 100% of the metal present in the mixture; and firing the coated insulator for about 30 to about 90 minutes in about one atmosphere of wet hydrogen at a temperature of from about 1450° to about 1520° C to cause the mixture to penetrate into the ceramic from a depth of from about one tenth millimeter to about three millimeters.

2. The invention of claim 1 wherein the mixture comprises about four parts manganese powder by weight of metal and about three parts titanium hydroxide by weight of metal.

3. The invention of claim 1 wherein the manganese powder comprises $MnO_2$.

4. The invention of claim 1 wherein the titanium powder comprises $TiO_2$.

5. The invention of claim 1 wherein the titanium powder comprises $TiH_2$.

6. The invention of claim 1 wherein said firing time is from about 40 to about 50 minutes.

* * * * *